US005607574A

United States Patent [19]

Hart

[11] Patent Number: 5,607,574

[45] Date of Patent: Mar. 4, 1997

[54] METHOD OF BREAKING REVERSE EMULSIONS IN A CRUDE OIL DESALTING SYSTEM

[75] Inventor: Paul R. Hart, The Woodlands, Tex.

[73] Assignee: BetzDearborn Inc., Trevose, Pa.

[21] Appl. No.: 437,338

[22] Filed: May 9, 1995

Related U.S. Application Data

[63] Continuation of Ser. No. 116,185, Sep. 2, 1993, abandoned.

[51] Int. Cl.[6] ..... C10G 33/00

[52] U.S. Cl. ..... 208/188; 208/187; 208/177

[58] Field of Search ..... 208/187, 188

[56] References Cited

U.S. PATENT DOCUMENTS

| | | | |
|---|---|---|---|
| 4,032,439 | 6/1977 | Oldham | 210/17 |
| 4,411,814 | 10/1983 | Burhardt | 252/344 |
| 4,686,066 | 8/1987 | Hofinger et al. | 252/344 |
| 4,800,039 | 1/1989 | Hassick et al. | 252/181 |
| 5,154,831 | 10/1992 | Darian et al. | 210/639 |
| 5,200,086 | 4/1993 | Shah et al. | 210/708 |
| 5,236,591 | 8/1993 | Hart | 210/639 |
| 5,282,974 | 2/1994 | Hart | 210/639 |

*Primary Examiner*—Helane Myers
*Attorney, Agent, or Firm*—Alexander D. Ricci; Steven D. Boyd

[57] ABSTRACT

A combination of aluminum chlorohydrate and a polyamine, such as polydiallyldimethyl ammonium chloride in an aqueous solution is described which is an effective emulsion breaker for reverse (oil-in-water) emulsions. The combination is effective at elevated temperatures and in a matrix comprising mostly oil as encountered in a crude oil desalter unit.

4 Claims, No Drawings

METHOD OF BREAKING REVERSE EMULSIONS IN A CRUDE OIL DESALTING SYSTEM

This is a continuation of application Ser. No. 08/116,185 filed on Sep. 2, 1993 now abandoned.

FIELD OF THE INVENTION

The present invention relates to a process of breaking reverse emulsions in a crude oil desalting system. More particularly, the present invention relates to an improved method of breaking an oil-in-water emulsion at elevated temperatures in a predominantly oil matrix as encountered in a crude oil desalting system.

BACKGROUND OF THE INVENTION

All crude oil contains impurities which contribute to corrosion, heat exchanger fouling, furnace coking, catalyst deactivation and product degradation in refinery and other processes. These contaminants are broadly classified as salts, bottom sediment and water, solids, and metals. The amount of these impurities vary depending upon the particular crude. Generally, crude oil salt content ranges between about 3 and 200 pounds per 1000 barrels.

Brines present in crude oil include predominantly sodium chloride with lesser amounts of magnesium chloride and calcium chloride being present. Chloride salts are the source of highly corrosive HCl which is severely damaging to refinery tower trays, and other equipment. Additionally, carbonate and sulfate salts may be present in the crude in sufficient quantities to promote crude preheat exchanger scaling.

Desalting is, as the name implies, adapted to remove primarily inorganic salts from the crude prior to refining. The desalting step is provided by adding and mixing with the crude oil a few volume percentages of fresh water to contact the brine and salts present in the crude.

In crude oil desalting, a water-in-oil emulsion is intentionally formed with the water admitted being on the order of about 2 to 10 volume percent based upon crude oil. Water is added to the crude and mixed intimately to transfer impurities in the crude to the water phase. Separation of the phases occurs due to coalescence of small water droplets into progressively larger droplets and eventually gravity separation of the oil and an underlying water phase occurs.

Wetting type water-in-oil demulsification agents are added, upstream from the desalter, to help in providing maximum mixing of the oil and water phases in the desalter. Known demulsifying agents include sulfonated oils, ethoxylated castor oils, ethoxylated phenolformaldehyde resins, a variety of polyether and polyester materials and many other commercially available compounds.

These demulsifiers, also called emulsion breakers, are fed to the crude so as to modify the stabilizer film formed initially at the oil/water interface. These emulsion breakers are surfactants that displace or inhibit emulsifiers that migrate to the interface, allowing droplets of water or brine to wet salt crystals and to coalesce more readily. The demulsifiers reduce the residence time required for good separation of water from oil.

Desalters are also commonly provided with electrodes to impart an electrical field in the desalter. This serves to polarize the dispersed water molecules. The so formed dipol molecules exert an attractive force between oppositely charged poles with the increased attractive force increasing the speed of water droplet coalescence by from 10 to 100 fold. The water droplets also distort quickly in the electrical field, thus thinning the stabilizing film and further enhancing coalescence.

Upon separation of the phases from the water-in-oil emulsion, the crude is commonly drawn off of the top of the desalter and sent to the fractionator tower in crude units or other refinery processes. The water phase containing water soluble metal salt compounds and the sediment is discharged as effluent. The water phase may also contain some contaminating oil in the form of oil-in-water emulsions which makes disposal of the water difficult.

These oil-in-water or "reverse" emulsions can form at the mix valve and remain unresolved as the water droplets coalesce and/or they can form by "inversion" of the coagulated water-in-oil emulsion to a water continuous form at the midvessel emulsion "cuff". In either case, these emulsions occur at elevated process temperatures (65° to 150° C.) and in the presence of a majority of bulk oil (50–98%).

Flocculant or coagulant type oil-in-water demulsification agents, also called reverse breakers, are sometimes used to break these emulsions downstream, where the emulsion has cooled and been separated from the bulk oil phase. These agents include various cationic organic polymers: polyamine condensates, polyvinylamines, polyaminoacrylates, and the like. They typically are not fed, and do not work well when they are fed, to the desalter influent wash water. There are many reasons for this: they are degraded by the mix valve shear, they hydrolyze at high temperatures, they viscosify the oil/water interface and impede water droplet coalescence, they coagulate and retain stabilizing solids, as polyelectrolytes they orient themselves with the electric field force lines, in the manner of electrorheological fluids, viscosifying the emulsion in the vicinity of the electrodes and impeding its passage. These effects have caused short-term and long-term failures in operating desalter systems.

SUMMARY OF THE INVENTION

The present inventor has found that a combination of aluminum chlorohydrate and a polyamine, such as polydiallyldimethyl ammonium chloride, in an aqueous solution is an effective emulsion breaker for reverse emulsions (oil-in-water) at elevated temperatures in a matrix comprising mostly oil. The combination of the present invention has been disclosed as a water clarification agent for reducing turbidity in water systems. However, the present inventor found that the present combination was unique among many water clarification agents in having the described emulsion breaking ability in a predominently oil matrix at elevated temperatures, in an electric field.

DESCRIPTION OF THE PREFERRED EMBODIMENTS

The process of the present invention provides for the improved separation of water from oil in an oil refinery desalter. The desalter may be any of the types commonly encountered in the refinery industry. The specific construction details of the desalter are not important to the present invention. However, it is noted that ordinarily, desalters are provided with electrodes to impart an electric field to the emulsion formed in the desalter to aid in coalesence of the water droplets to facilitate resolution of the emulsion.

Typically, desalter temperatures are maintained at from 65° to 150° C. Heat lowers the viscosity of the continuous phase (the oil phase) thereby speeding the settlement of the coalesced water droplets as governed by Stokes law. Heat also increases the ability of the bulk oil to dissolve certain organic emulsion stabilizers that may have been added or are naturally occurring in the crude oil.

Desalter pressure is kept high enough to prevent crude oil or water vaporization. Desalter pressures at operating temperatures should be about 20 psi above the crude oil or water vapor pressure, whichever is higher.

The use of emulsion breakers, also called demulsifiers, is known. Typical oil based demulsifiers employed in crude oil desalting include alkylphenol, alkylamine, alkylol, and polyol alkoxylates with or without cross linking with aldehydes, di- or multi-functional acids, epoxides, isocyanates and the like.

The inventor of the present invention discovered that the addition of a treatment solution comprising a blend of polyamine, preferably poly(diallyldimethylammonium chloride) [poly(DADMAC)] with aluminum chlorohydrate in an aqueous solution was effective at breaking reverse (oil-in-water) emulsions at high temperatures (65° to 150° C.) in a matrix comprising mostly oil (51–99% oil).

The method of the present invention comprises feeding the treatment solution to a crude oil desalter, with the washwater feed. The treatment solution is effective as a reverse emulsion breaker when exposed to typical desalter conditions.

The washwater fed to a desalter typically comprises 2 to 10% of the crude oil charged to the desalting vessel. The treatment solution of the present invention is added to the washwater feed stream in concentrations of from about 10 to 100 parts per million based on water, or 0.5 to 50 parts per million based on crude oil. The ratio of aluminum chlorohydrate to poly(DADMAC) is from about 3 to 1 to 7 to 1 and preferrably 5 to 1 (by actives).

The treatment solution of the present invention has been disclosed as a water clarification agent for use in the flocculation of suspended matter in aqueous solutions. For example, U.S. Pat. No. 4,800,039. However, the inventor of the present invention found that the combination of aluminum chlorohydrate and poly(DADMAC) was unique among known water clarification agents for its ability to enhance the breaking of reverse emulsions at the conditions of temperature and oil present in a crude oil desalting system.

The unique temperature and oil compatability features of the treatment solution of the present invention allows it to be added to the washwater fed to the desalter, producing an oil and oily solids free effluent brine from the desalter without the need for secondary treatment of the effluent brine stream.

The present invention will now be described with reference to a number of specific examples which are to be regarded solely as illustrative and not as restricting the scope of the invention.

Table I summarizes the properties and descriptions of the materials tested in the examples.

TABLE 1

| Designation | Description | | Percent Active |
|---|---|---|---|
| A | AETAC:AM Copolymer (40:60 mole ratio) | $10^7$MW | 42 |
| B | AETAC:AM Copolymer (52:48 mole ratio) | $10^7$MW | 46 |
| C | MAPTAC:AM Copolymer (10:90 mole ratio) | $10^7$MW | 41 |
| D | MAPTAC:AM Copolymer (42:58 mole ratio) | $10^7$MW | 41 |
| E | AETAC:AM Copolymer (2.98 mole ratio) | $10^7$MW | 31 |
| F | METAC:AM Copolymer (9.91 mole ratio) | $10^7$(linear) | 38 |
| G | AETAC:AM Copolymer (10:90 mole ratio) | $10^7$(Graft) | 34 |
| H | METAC:AM Copolymer (10:90 mole ratio) | $10^7$(Graft) | 35 |
| I | DMA:EPI;DMAPA Terpolymer | $10^4$MW | 31 |
| J | DADMAC Polymer | $10^5$MW | 19 |
| K | AETAC:AM:AA Terpolymer | $10^5$MW | 14 |
| L | ADA:DETA;EPI Terpolymer + J + K | $10^4$MW | 15 |
| M | Polyalkanolamine | $10^4$MW | 35 |
| N | Blend of M and O (1:1 by actives) | $10^4$MW | 15 |
| O | Blend of quaternary amine EO adducts | $10^3$MW | 23 |
| P | $Al_2Cl(OH)_5$ + Poly(DADMAC) (5:1 by actives) | $10^5$MW | 15 |

AA = Acrylic Acid,
AM = Acrylamide,
AETAC = Acryloxyethyltrimethylammonium chloride,
MAPTAC = Methacrylamidopropyltrimethylammonium chloride
METAC = Methacryloxyethyltrimethylammonium chloride
DMA = Dimethylamine,
EPI = epichlorohydrin,
DMAPA = Dimethylaminopropylamine,
DADMAC = Dialkyldimethylamonium chloride,
ADA = adipic acid,
DETA = Diethylenetriamine,
EO = Poly(ethylene oxide).

In order to access the efficacy of the demulsification method of the present invention, separation tests were conducted on crude oil in a simulated desalter apparatus. The simulated desalter comprises an oil bath reservoir provided with a plurality of test cell tubes disposed therein. The temperature of the oil bath can be varied to about 150° C. to simulate actual field conditions. The test cells were inserted into a perforated plate capacitor to impart an electric field of variable potential through the test emulsions contained in the test cell tubes.

EXAMPLE 1

Demulsification tests were conducted on an oily desalter effluent brine at 95° C. The effluent brine was about 60% water and was a light chocolate brown oil-in-water emulsion with 4% free water-in-oil emulsion floating. Table 2 summarizes the results.

TABLE 2

| Treatment | Dose (ppm Product) | Clarity Rating* |
|---|---|---|
| A | 80 | 2 |
| B | 80 | 1 |
| C | 80 | 6 |
| D | 80 | 4 |
| E | 80 | 8 |
| F | 80 | 4 |
| G | 80 | 7 |
| H | 80 | 6 |

TABLE 2-continued

| Treatment | Dose (ppm Product) | Clarity Rating* |
|---|---|---|
| I | 80 | 6 |
| J | 160 | 6 |
| K | 160 | 5 |
| L | 160 | 5 |
| M | 160 | 7 |
| N | 160 | 8 |
| O | 160 | 8 |
| P | 160 | 3 |
| P | 240 | 2 |
| P | 320 | 1 |
| Blank | — | 8 |

*the clarity rating ranges from 1 (clear) to 8 (no effect)

EXAMPLE 2

Demulsification tests were conducted on an emulsion collected from the bottom of a desalter water leg at 93° C. The sample was about 60% water and was a dark chocolate brown, oil-in-water emulsion with 40% free water-in-oil emulsion floating. Table 3 summarizes the results.

TABLE 3

| Treatment | Dose (ppm Product) | Amount of Water Emulsion | Clarity of Water Emulsion |
|---|---|---|---|
| A | 500 | 85% | dark brown opaque |
| B | 500 | 85% | dark brown opaque |
| D | 500 | 80% | dark brown opaque |
| F | 500 | 78% | dark brown opaque |
| J | 1000 | 80% | dark brown opaque |
| K | 1000 | 80% | dark brown opaque |
| L | 1000 | 80% | dark brown opaque |
| P | 1000 | 70% | clear |
| A + P | 500 + 500 | 85% | almost clear |
| A + P | 400 + 600 | 85% | yellow transluscent |
| B + P | 400 + 600 | 85% | almost clear |
| L + P | 800 + 600 | 80% | brown transluscent |
| Blank | | 60% | dark brown opaque |

EXAMPLE 3

Demulsification tests were conducted on a 98% crude, 2% washwater mixture. The crude oil was treated with a blend of nonylphenolformaldehyde resin ethoxylates and polypropylene glycol ethoxylates (designated X in Table 4). The washwater was treated (as indicated in Table 4) before it was mixed with the crude. Table 4 summarizes the results.

TABLE 4

| Treatment to Oil | Dose (ppm Product) | Treatment to Water | Dose (ppm Product) | Mean Water Drop (%)** |
|---|---|---|---|---|
| X | 24 | none | 0 | 1.26 |
| X | 21 | A | 2 | 0.96 |
| X | 21 | B | 2 | 1.02 |
| X | 21 | L | 4 | 0.98 |
| X | 21 | P | 5 | 1.30 |
| X | 18 | A + P | 2 + 5 | 1.22 |

**Amount of water resolved from the emulsion and dropped to the bottom of the test tube - average of 5 temporally sequential readings.

As can be seen from the tables, treatment P of the present invention is an effective reverse emulsion breaker while other, known, water clarification agents are not. The data shows that the water clarity of the effluent water stream in a crude oil desalter improves significantly when the treatment solution of the present invention is added to the water fed to the desalter system. The method of the present invention obviates the need for effluent brine treatment.

Table 3 shows that treatment P is more "oil compatible" than the other treatments tested. Table 4 shows that treatment P does not adversely affect and may in fact improve the resolution of the 5% water-in-oil emulsion created in the desalter system.

While the present invention has been described with respect to particular embodiments thereof, it is apparent that other forms and modifications of the invention will be obvious to those skilled in the art. The appended claims and this invention generally should be construed to cover all such obvious forms and modifications which are within the true spirit and scope of the present invention.

What is claimed is:

1. A method of resolving an oil in water emulsion in a crude oil desalting system operating at a temperature of from about 65° to about 150° C. wherein the matrix is predominently oil comprising adding to a crude oil desalting system was water feed a treatment solution comprising aluminum chlorohydrate and poly(diallyldimethylammonium chloride) having a molecular weight of about 100,000.

2. The method of claim 1 wherein from about 25 to 50 about parts per million of said treatment solution based upon crude oil is added to said desalter system.

3. The method of claim 1 wherein the ratio of aluminum chlorohydrate to poly(diallyldimethyl ammonium chloride) is from about 3 to 1 to 7 to 1.

4. The method of claim 1 wherein the ratio of aluminum chlorohydrate to poly(diallyldimethyl ammonium chloride) is about 5 to 1.

* * * * *